US006743047B2

(12) United States Patent
Korsunsky et al.

(10) Patent No.: US 6,743,047 B2
(45) Date of Patent: Jun. 1, 2004

(54) ELECTRICAL CONNECTOR WITH REAR GROUND PLATE

(75) Inventors: Iosif R. Korsunsky, Harrisburg, PA (US); Kevin E. Walker, Hershey, PA (US); James H. Hyland, Hummelstown, PA (US); Jen Jou Chang, Tu-chen (TW); Li-Chun Wu, Tu-Chen (TW); Qisheng Zheng, Kunsan (CN); Zhenghua Xu, Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/279,807

(22) Filed: Oct. 23, 2002

(65) Prior Publication Data

US 2004/0082208 A1 Apr. 29, 2004

(51) Int. Cl.[7] ..... H01R 13/60
(52) U.S. Cl. ..... 439/540.1; 439/607; 439/676
(58) Field of Search ..... 439/76.1, 108, 439/540.1, 607, 608, 676

(56) References Cited

U.S. PATENT DOCUMENTS

| | | | | |
|---|---|---|---|---|
| 4,878,858 A | | 11/1989 | Dechelette | |
| 5,083,945 A | | 1/1992 | Miskin et al. | |
| 5,282,759 A | | 2/1994 | Sakamoto et al. | |
| 5,378,172 A | | 1/1995 | Roberts | |
| 5,766,041 A | | 6/1998 | Morin et al. | |
| 5,775,946 A | | 7/1998 | Broines | |
| 5,788,538 A | | 8/1998 | Belopolsky et al. | |
| 6,159,039 A | * | 12/2000 | Wu | 439/541.5 |
| 6,206,725 B1 | * | 3/2001 | Wu | 439/541.5 |
| 6,210,237 B1 | * | 4/2001 | Chang | 439/676 |
| 6,238,247 B1 | | 5/2001 | Belopolsky et al. | |
| 6,299,480 B1 | * | 10/2001 | Xu et al. | 439/607 |
| 6,302,741 B1 | | 10/2001 | Fasold et al. | |
| 6,474,999 B1 | * | 11/2002 | Givens et al. | 439/76.1 |
| 6,511,348 B1 | * | 1/2003 | Wojtacki et al. | 439/620 |

* cited by examiner

*Primary Examiner*—Javaid H. Nasri
*Assistant Examiner*—Thanh-Tam Le
(74) *Attorney, Agent, or Firm*—Wei Te Chung

(57) ABSTRACT

An electrical connector (100) mounted on a main printed circuit board (PCB), includes an insulative housing (1) defining at least one cavity (11, 12), an insert module (3) received in the housing, a rear ground plate (4), and an outer shell (2). The insert module includes a plurality of contacts (31, 32) extending into the cavity of the housing, and at least one internal PCB (53) containing at least one ground pad. The rear ground plate is coupled to a rear portion of the insert module and includes at least one upper grounding contact (41) electrically connecting with ground pad of the internal PCB and at least one lower grounding contact (43) extending downwardly for engaging with a ground pad of the main PCB. The outer shell is provided for surrounding the insulative housing with the rear ground plate sandwiched therebetween.

2 Claims, 12 Drawing Sheets

ELECTRICAL CONNECTOR WITH REAR GROUND PLATE

CROSS-REFERENCE TO RELATED APPLICATION

This application is related to a contemporaneously filed US patent application entitled "ELECTRICAL CONNECTOR WITH RETENTION MECHANISM OF OUTER SHELL", and US patent application entitled "STACKED MODULAR JACK ASSEMBLY HAVING IMPROVED ELECTRIC CAPABILITY", filed on Sep. 11, 2002, with a serial number 10/242024, all assigned to the common assignee.

BACKGROUND OF THE INVENTION

1. Field of the Invention

The present invention relates to electrical connectors and more particularly, to a multi-port modular jack for being mounted on a printed circuit board (PCB) with additional ground plate.

2. Description of the Prior Art

With ever-increasing operating frequencies of data and communication systems and an increased density of information to be transmitted, the electrical characteristics of modular jacks are of increasing importance. In particular, it has to be ensured that modular jacks do not have bad effects on the signals to be transmitted and that no additional interference is introduce to minimize negative interference. Modular jacks can use various types of filters, such as a three-terminal capacitor or a common mode choke coil, to reduce or eliminate noise, and grounding means is needed to remove the noises.

U.S. Pat. No. 5,282,759 issued to Sakamoto et al. on Feb. 1, 1994 disclosed a conventional modular jack. The Sakamoto modular jack includes an insulative body case, terminals, a capacitor array acting as a filter, a cover and an inverted-U-Shaped grounding terminal. The grounding terminal includes a right and a left side plates and a connecting plate. By inserting the side plates in slots disposed on opposite sides of the body case until small projections of the side plates get stuck in corresponding slots, the grounding terminal is fixed on the body case. The connecting plate of the grounding terminal is in contact with the common electrode of the capacitor array. The side plates of the grounding terminal protrude their claws from the slots of the body case, and the claws are inserted into holes of a circuit board of an electronic appliance and soldered to a grounding line formed on the circuit board. In this way, the common electrode of the capacitor array is connected with the grounding line of the electronic appliance through the grounding terminal.

However, the grounding terminal disclosed by Sakatoto et al. uses the connecting plate contacting with the common electrode of the capacitor array, which is a relatively weak connection. Moreover, the inverted-U-shaped grounding terminal is relatively large when used in stacked modular jack application and the assemble process is complicated. Furthermore, in high speed application, additional ground connections are needed for removing noises promptly. The mounting process and ground connection become more complicated when more ports are integrally made as an assembly.

Hence, an electrical connector with improved ground means is needed to overcome the foregoing shortcomings.

BRIEF SUMMARY OF THE INVENTION

A main object of the present invention is to provide an electrical connector with a ground plate for removing noises promptly.

Another object of the present invention is to provide an electrical connector with a ground plate, which is easy to assemble.

An electrical connector mounted on a main printed circuit board (PCB), includes an insulative housing defining at least one cavity, an insert module received in the housing, a rear ground plate, and an outer shell. The insert module includes a plurality of contacts extending into the cavity of the housing, and at least one internal PCB containing at least one ground pad. The rear ground plate is coupled to a rear portion of the insert module and includes at least one upper ground contact electrically connecting with ground pad of the internal PCB and at least one lower ground contact extending downwardly for engaging with a ground pad of the main PCB. The outer shell is provided for surrounding the insulative housing with the rear ground plate sandwiched therebetween.

Other objects, advantages and novel features of the invention will become more apparent from the following detailed description when taken in conjunction with the accompanying drawings.

DETAILED DESCRIPTION OF THE INVENTION

Figure 1:
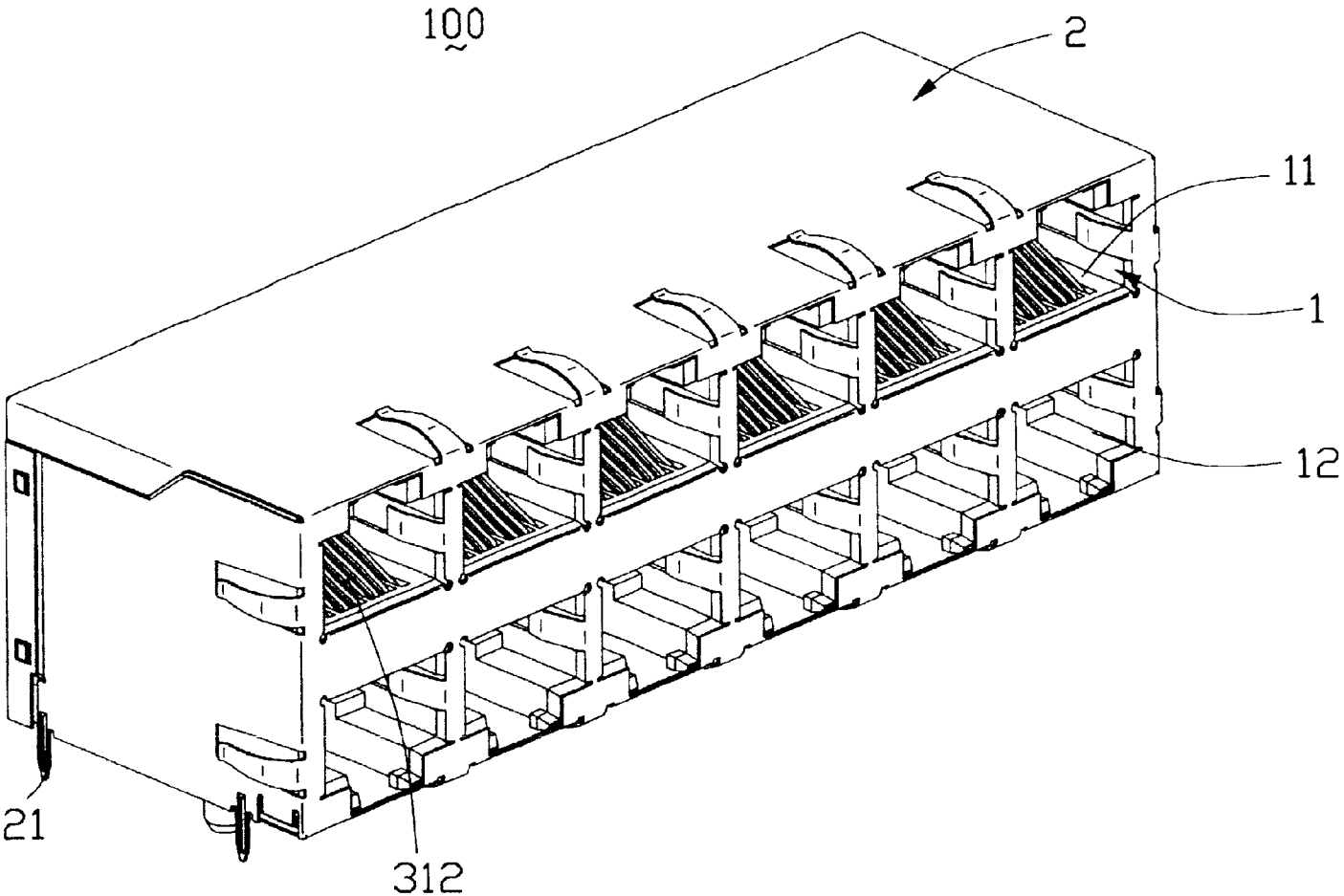
FIG. 1 is a perspective view of a modular jack according to a first embodiment of the present invention.
Figure 6:
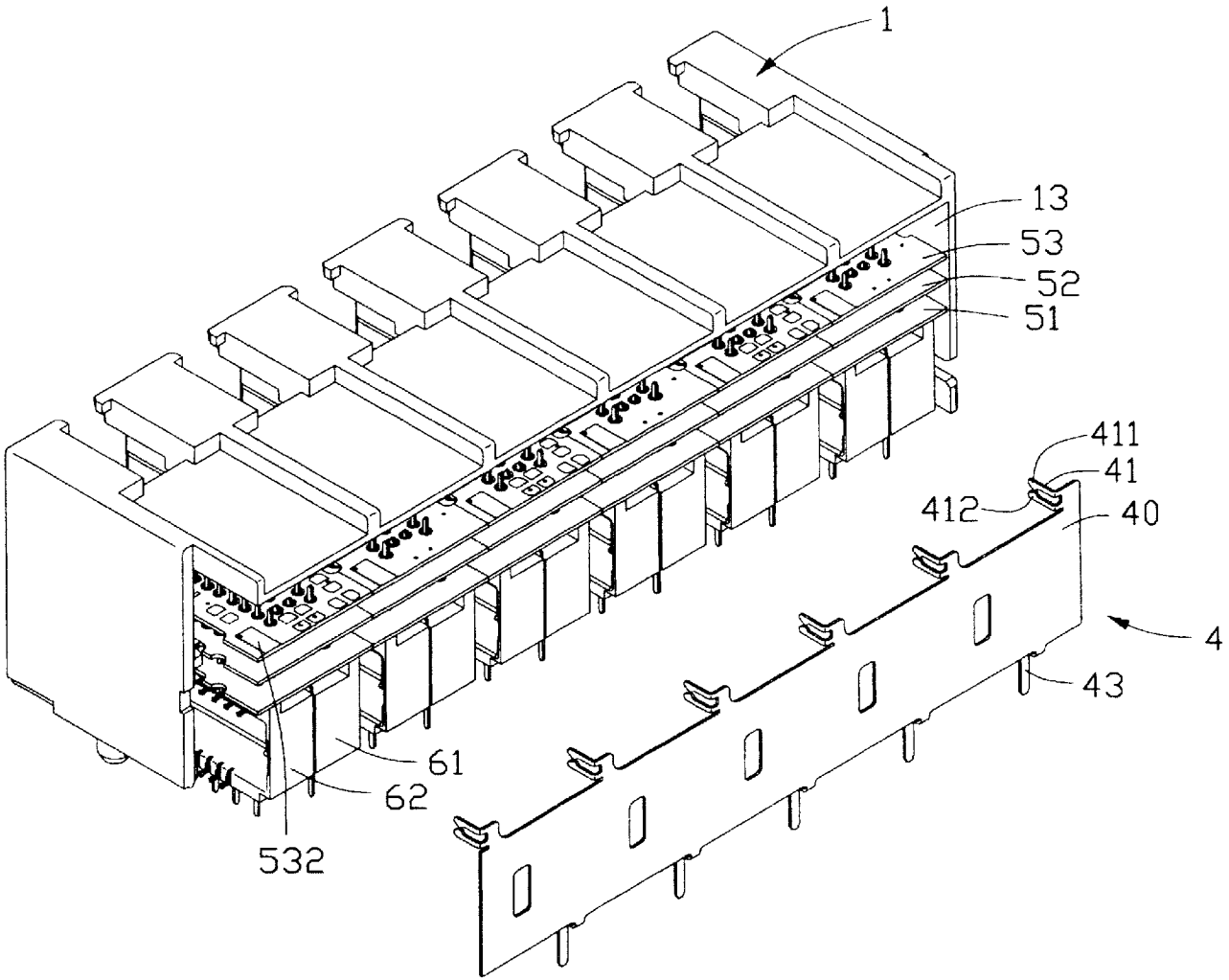
FIG. 6 is an exploded view of FIG. 1 without an outer shell.

Referring to FIGS. 1 and 6, a modular jack 100 mounted on a main printed circuit board (PCB, not shown) includes an insulative housing 1, a plurality of insert modules 3 (shown in FIG. 2) received in the housing 1, a rear ground plate 4, and an outer shell 2 substantially surrounding and shielding the housing 1. The modular jack 100 is preferably a multi-port modular jack, which defining a plurality of upper and lower cavities 11, 12 for receiving a plurality of mating modular plugs (not shown), and a rear opening 13 for receiving the insert modules 3. The main PCB has a plurality of grounding through holes (not shown). The outer shell 2 includes a plurality of solder tails 21 extending downwardly from a rear portion thereof for engaging with the grounding through holes of the main PCB.

Figure 2:
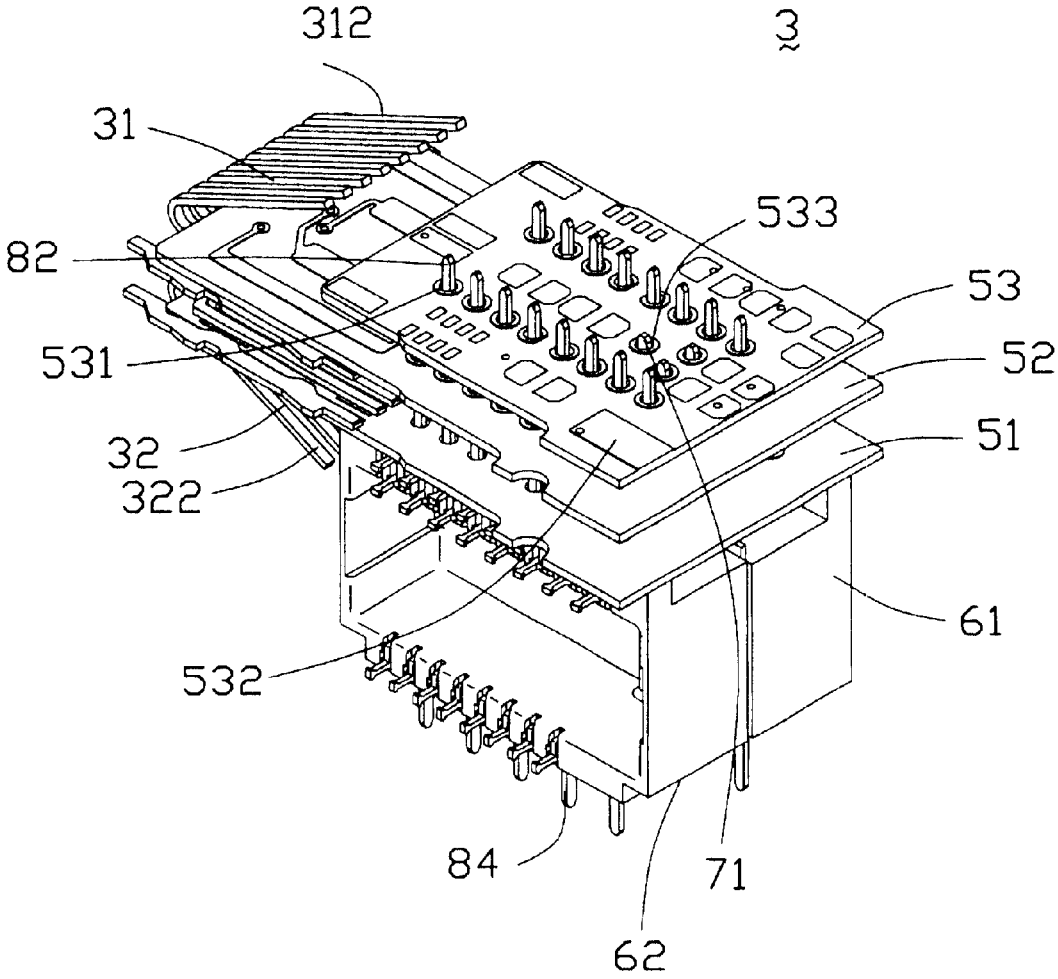
FIG. 2 is a perspective view of an insert module of the modular jack in FIG. 1.
Figure 3:
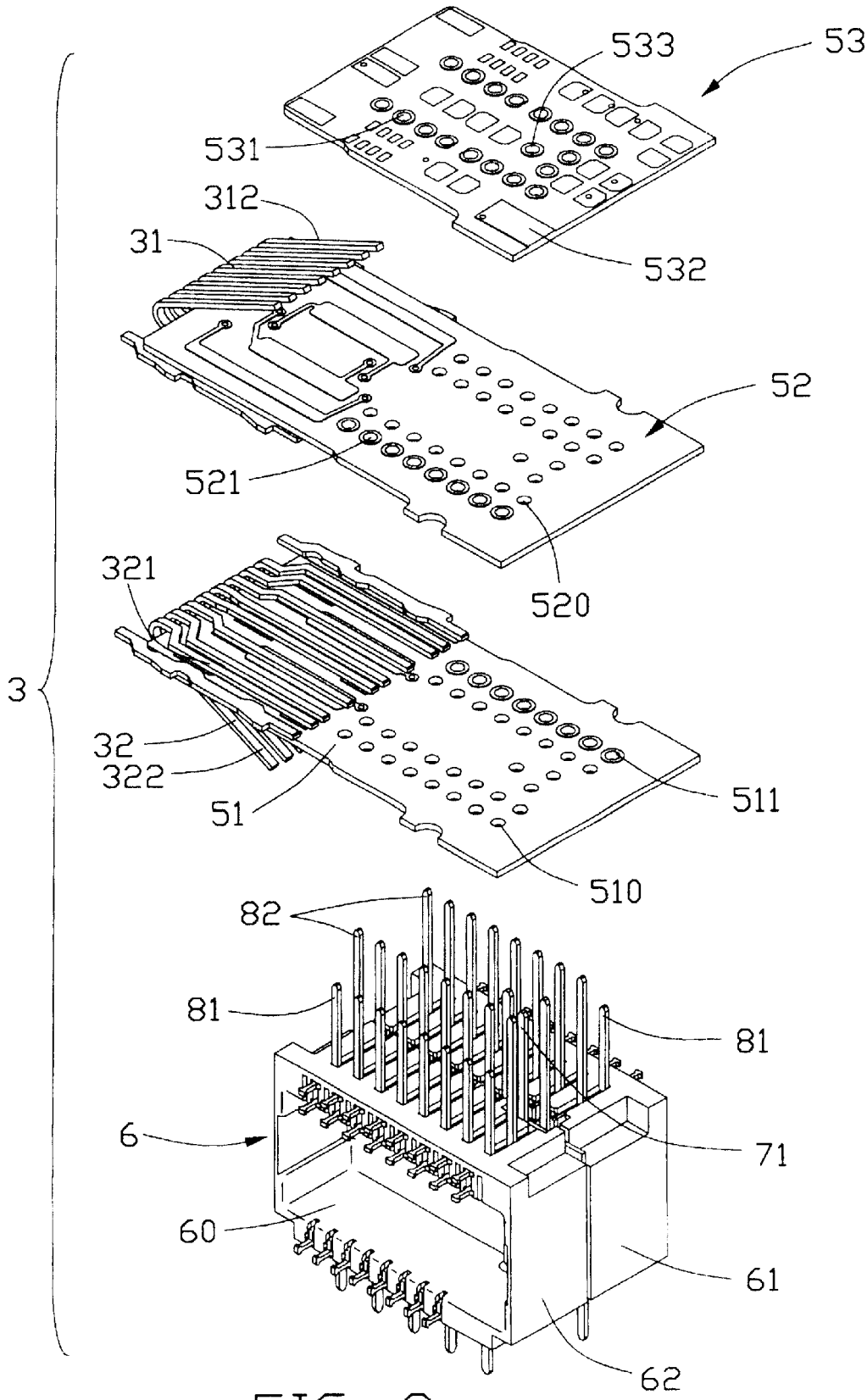
FIG. 3 is an exploded view of FIG. 2.

Referring to FIGS. 2 and 3, each insert module 3 includes a plurality of lower and upper contacts 32 and 31, a first, second and third internal PCBs 51, 52 and 53, and a magnetic assembly 6. The upper contacts 32 has upper contact portions 312 extending into a corresponding upper cavity 11 for electrically engaging with a modular plug and upper solder portions (not shown) for surface mounted to the second internal PCB 52. The lower contacts 31 has lower contact portions 322 inserted into a corresponding lower cavity 12 for electrically engaging with a corresponding modular plug, and lower solder portions 321 for surface mounted to the first internal PCB 51. The first and the second internal PCBs 51, 52 respectively define a plurality of through holes 510, 520 and a plurality of soldering holes 511, 521. The third internal PCB 53 includes a plurality of electronic elements (not shown). The electronic elements are preferably resistors and capacitances. The third internal PCB 53 defines a plurality of soldering holes 531, a grounding through hole 533 and a grounding pad 532 electrically connected with the capacitive array.

Figure 4:
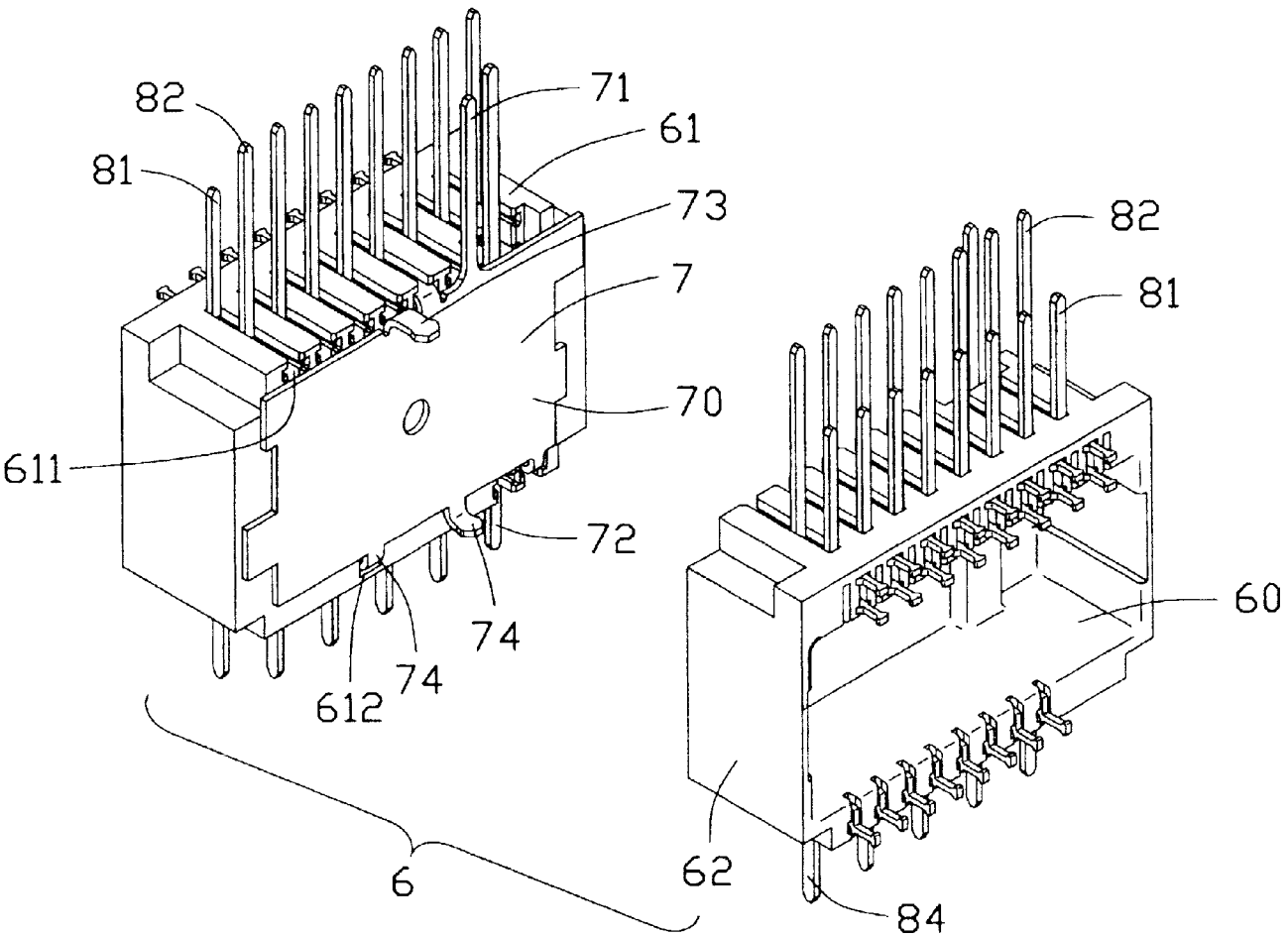
FIG. 4 is an exploded view of a magnetic assembly of the insert module in FIG. 2.
Figure 5:
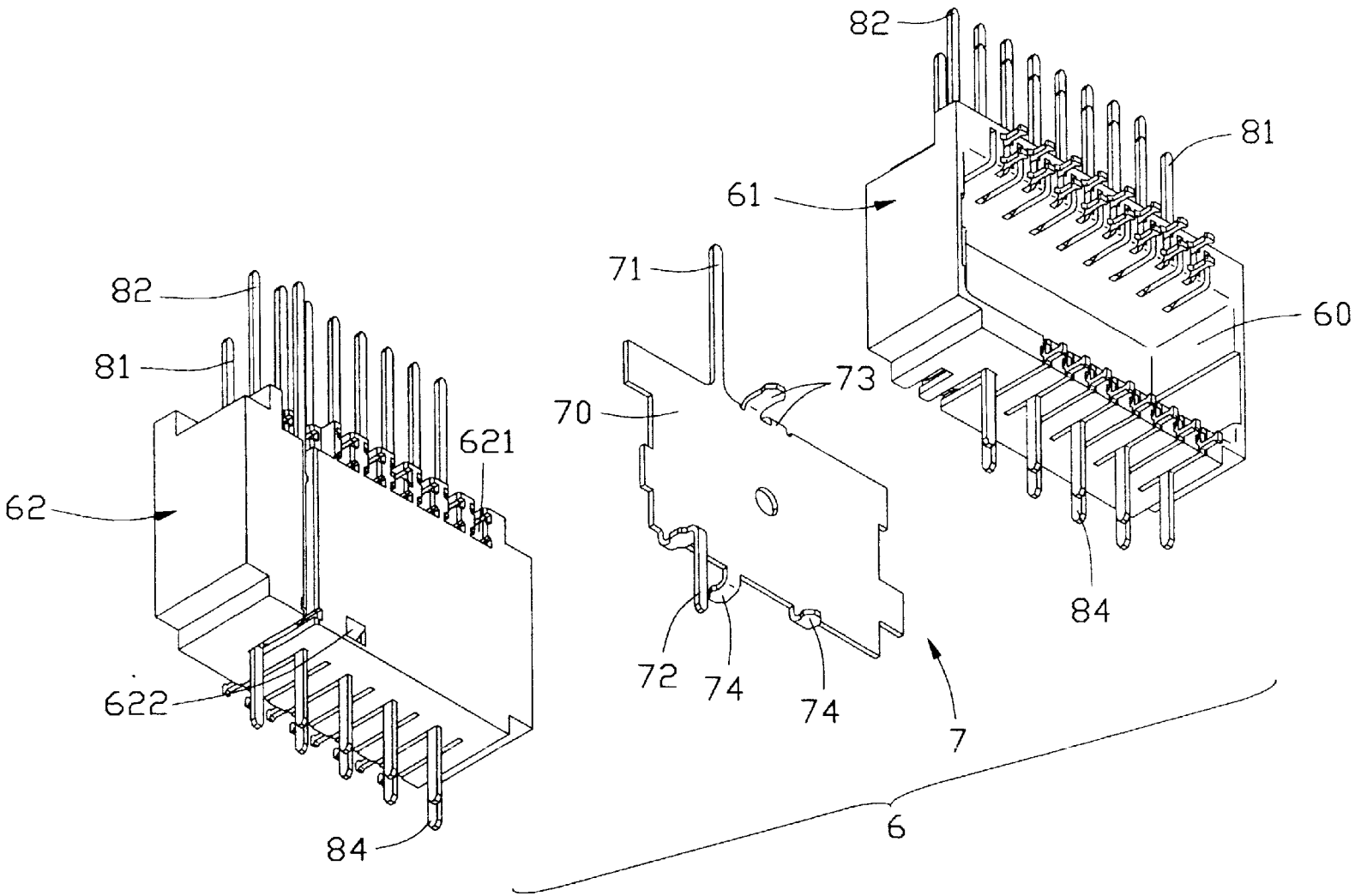
FIG. 5 is another exploded view of the magnetic assembly.

Referring to FIGS. 4 and 5, the magnetic assembly 6 includes a first and a second magnetic boxes 61, 62, a plurality of short and long conductors 81, 82 mounted in an upper portion of the first and the second magnetic boxes 61, 62 and projecting upwardly, lower conductors 84 mounted in a lower portion of the first and the second magnetic boxes 61, 62 and projecting downwardly, and an internal ground plate 7 interposed between the first and the second magnetic boxes 61, 62. Each of the first and the second magnetic boxes 61, 62 defines a chamber 60 for receiving magnetic coils (not shown) therein. The magnetic coils electrically connect with the upper and lower conductors 81, 82 and 84, whereby each of the first and the second magnetic boxes 61, 62 acts as a signal conditioning device for respectively suppressing noises, which is well know to those skilled in the art. The ground plate 7 has a generally planar body portion 70. A grounding pin 71 extends upwardly from an upper portion of the body portion 70. A grounding tail 72 extends downwardly from a lower portion of the body portion 70 and offsets from the body portion 70. A pair of upper retaining barbs 73 extends from an upper edge of the body portion 70 and respectively toward the first and the second magnetic boxes 61, 62. A pair of lower retaining barbs 74 extends from a lower edge of the body portion 70 and respectively toward the first and the second magnetic boxes 61, 62. The first magnetic box 61 defines a plurality of recesses 611 in an upper portion thereof and an indention 612 in a lower portion thereof. One of the recesses 611 engages with the upper retaining barb 73 of the ground plate 7. The indentation 612 engages with the lower retaining barb 74 of the ground plate 7. The second magnetic box 62 also defines recesses and an indention as the first magnetic box 61 does, which is not shown in the drawings, for engaging with corresponding upper and lower retaining barbs 73, 74 of the second magnetic box 62, whereby the first and the second magnetic boxes 61, 62 are tightly mechanically coupled to each other as a magnetic assembly 6 as shown in FIG. 3.

Referring to FIG. 6, the rear ground plate 4 includes a generally planar body plate 40, a plurality of upper grounding contacts 41 projecting forwardly from an upper portion of the body plate 40 and generally perpendicular to the body plate 40, a plurality of lower grounding contacts 43 extending downwardly from a lower portion of the body plate 40 and offset from the body plate 40. The grounding contact 41 is preferably forked with an upper and a lower tabs 411, 412.

In assembly, as shown in FIGS. 2 and 3, the short conductors 81 of the second magnetic box 62 extend through the through holes 510 of the first internal PCB 51, and soldered in the soldering holes 521 of the second internal PCB 52 which electrically connecting with the upper contacts 31, thereby electrically connecting the upper contacts 31 with corresponding magnetic coils of the second magnetic box 62. The short conductors 81 of the first magnetic box 61 extend through and soldered in the soldering holes 511 of the first internal PCB 51 which electrically connecting with the lower contacts 32, and through the through holes 520 of second internal PCB 52, thereby electrically connecting the lower contacts 32 with corresponding magnetic coils of the first magnetic box 61. The grounding pin 71 of the ground plate 7 extends through a corresponding through hole 510, 520 of the first and the second internal PCBs 51, 52 and is soldered in the grounding through hole 533 of the third internal PCB 53. The long conductors 82 extends through the corresponding through holes 510, 520 of the first and the second internal PCBs 51, 52 and are soldered in the soldering holes 531 of the third internal PCB 53 and come into electrically connecting with the capacity array, thereby electrically connecting the capacity array with corresponding magnetic coils of the first and the second magnetic boxes 61, 62.

Figure 7:
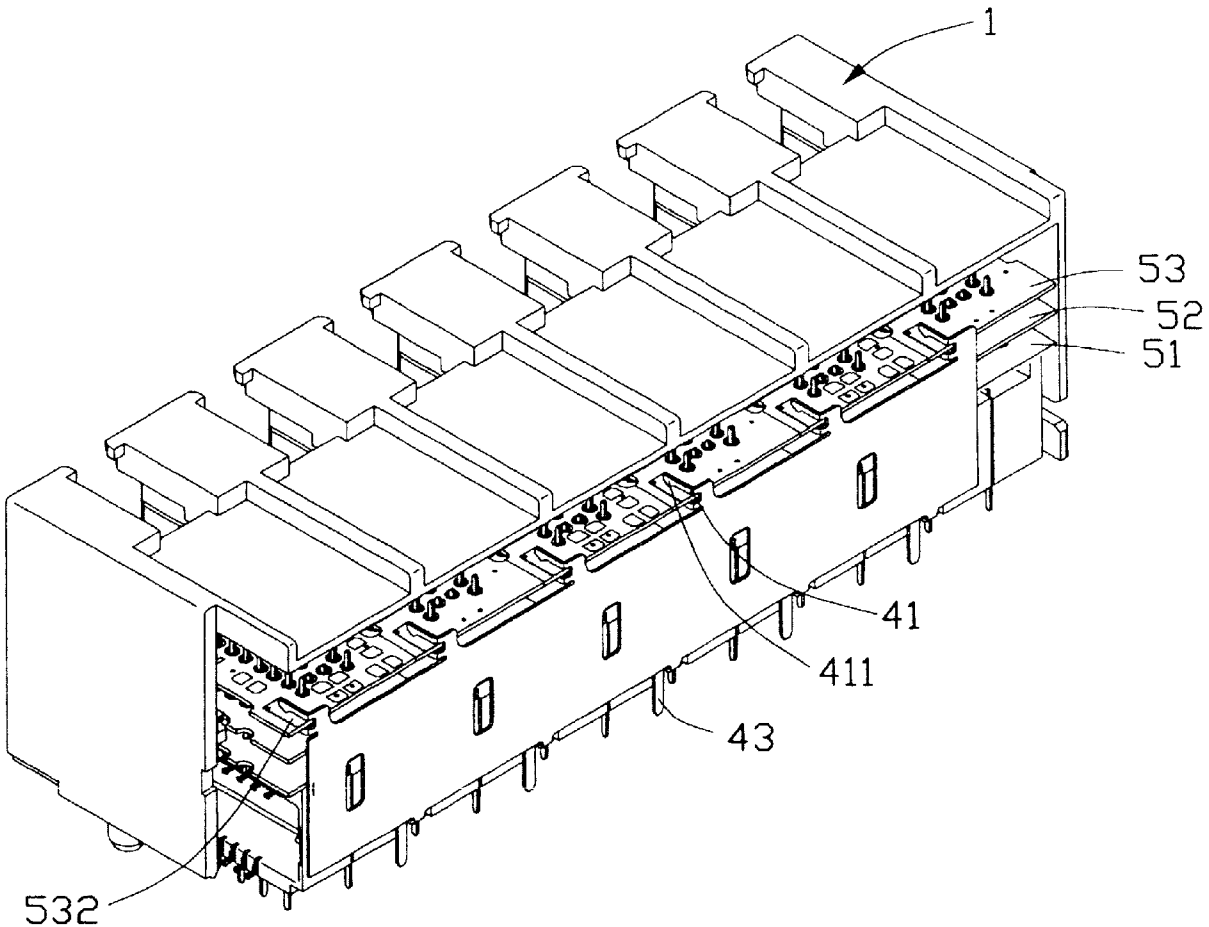
FIG. 7 is an assembled view of FIG. 6.
Figure 8:
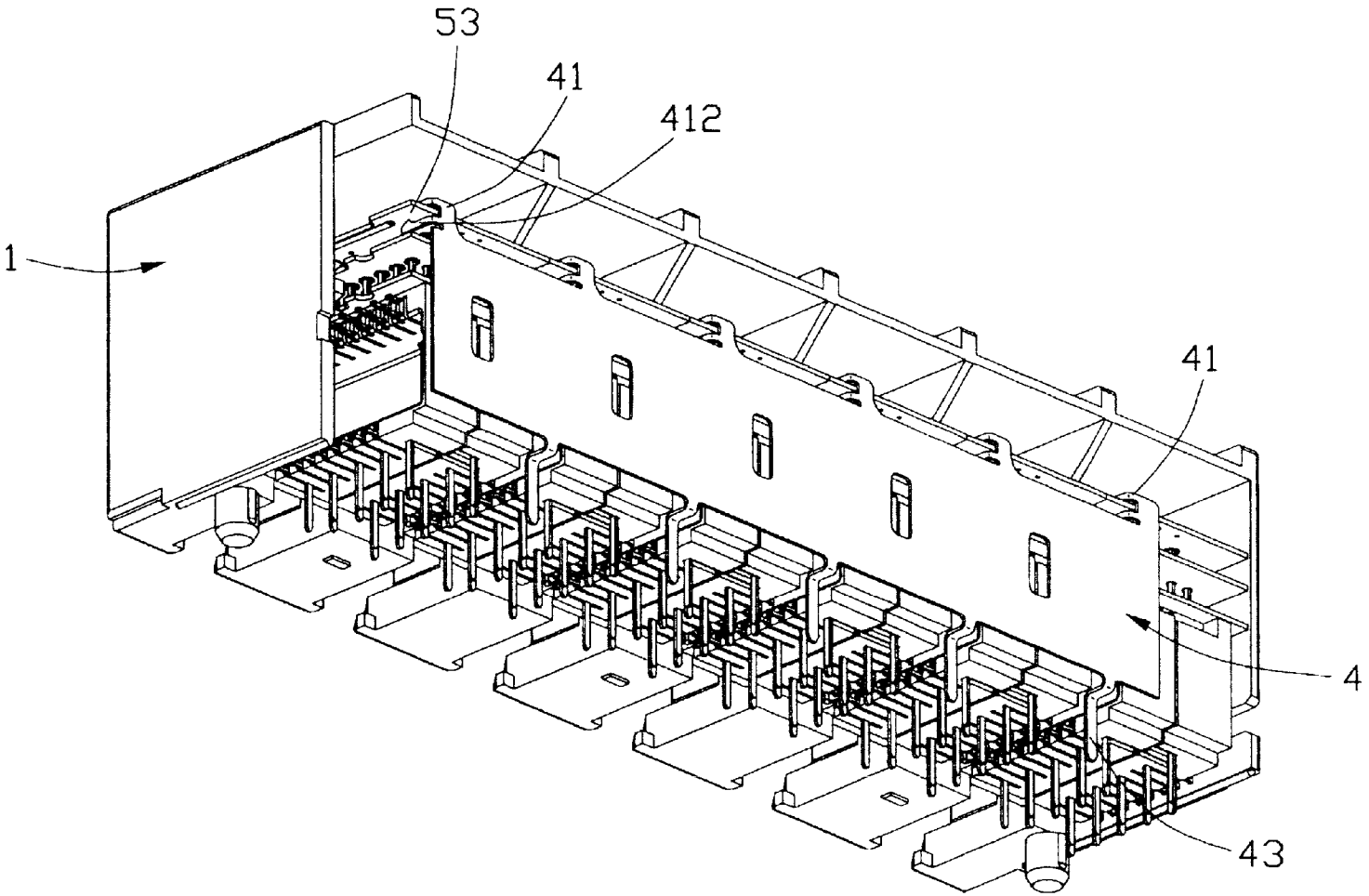
FIG. 8 is another assembled view of FIG. 6 taken from a bottom aspect.

Referring to FIGS. 6, 7 and 8, the insert modules 3 are inserted into the insulative housing 1 from the rear opening 13 of the insulative housing 1. The rear ground plate 4 is attached to the insert modules 3 with upper and lower tabs 411, 412 of the upper grounding contacts 41 receiving a rear portion of the third internal PCB 53 therein and engaging with grounding pads 532 of the third internal PCB 53.

Figure 9:
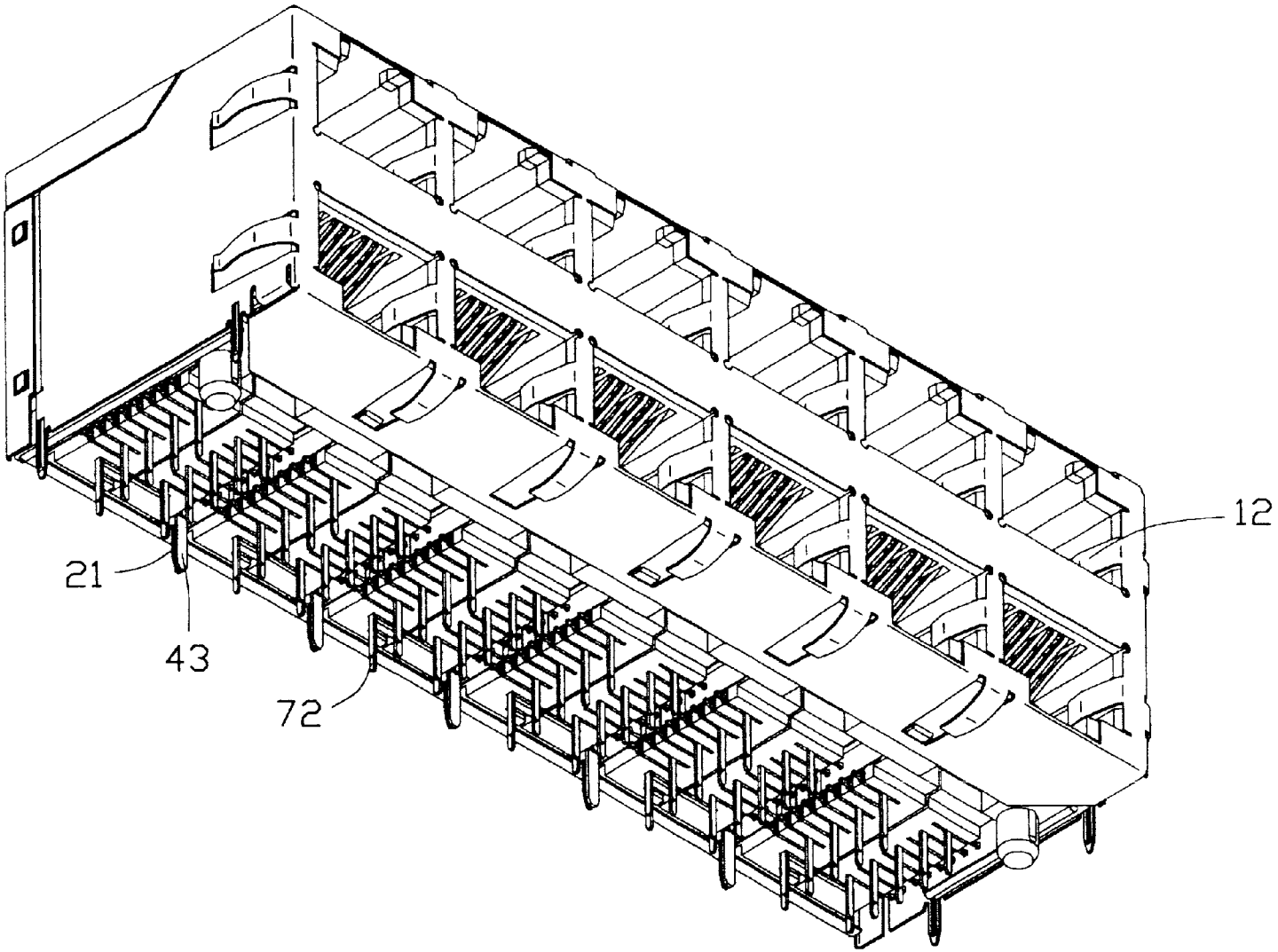
FIG. 9 is an assembled view of the modular jack taken from a bottom aspect.

Referring to FIG. 9, the outer shell 2 substantially surrounds the insulative housing 1, the insert modules 3, and the rear ground plate 4. Each lower grounding contact 43 of the ground plate 4 abuts against a corresponding solder tail 21 of the outer shell 2, and soldered in the same corresponding grounding through holes of the main PCB. The grounding tails 72 are soldered to the corresponding grounding through holes of the main PCB.

Figure 10:
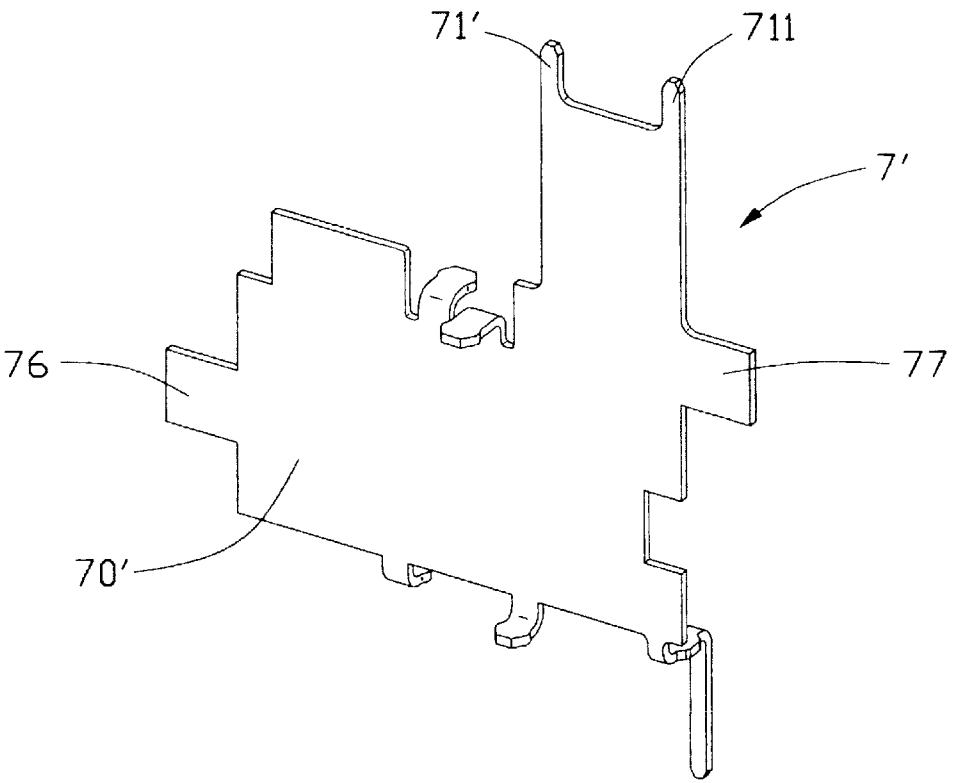
FIG. 10 shows a perspective view of an inner ground plate of a modular jack according to a second embodiment of the present invention.
Figure 11:
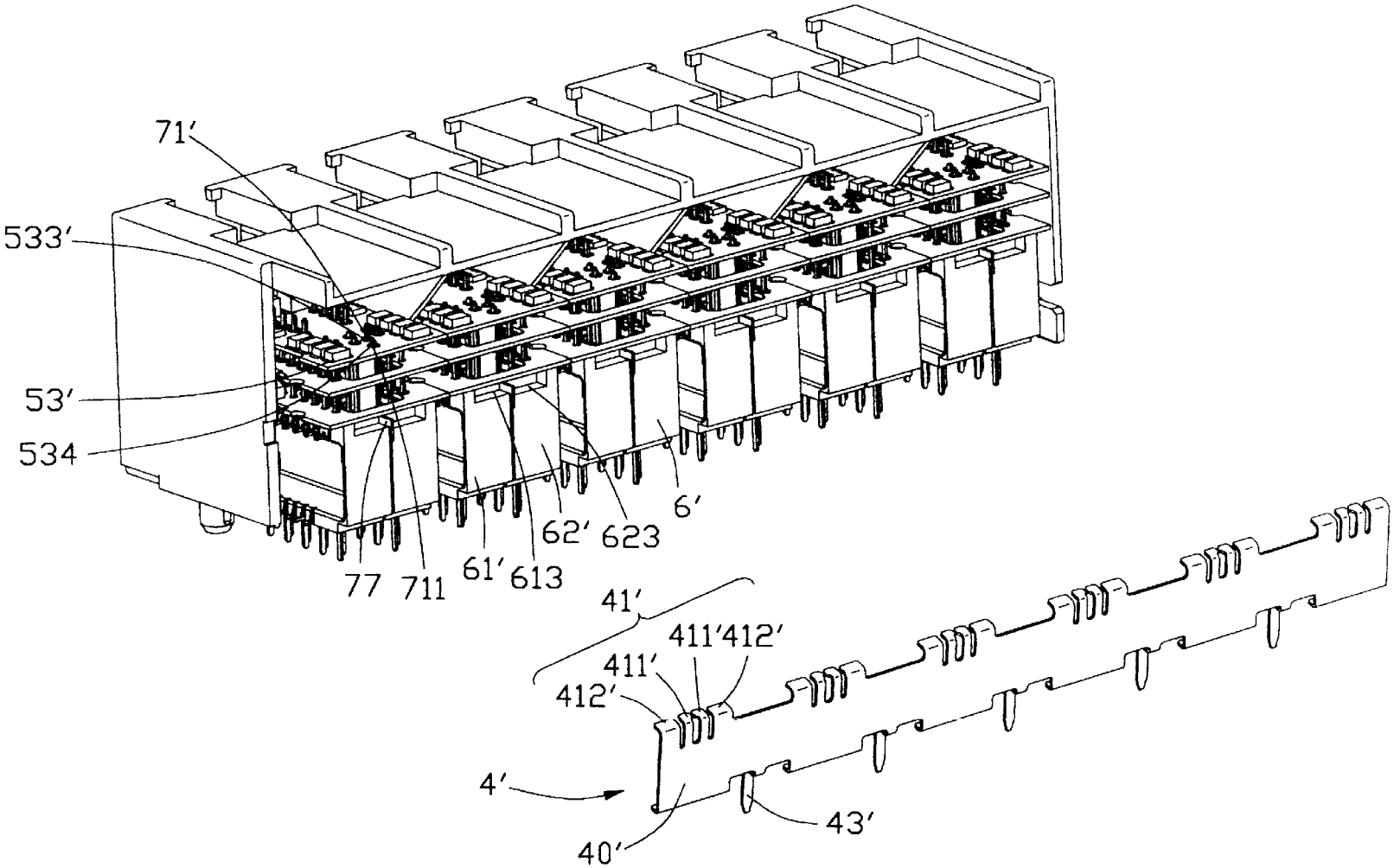
FIG. 11 shows a sub-assembled view of the modular jack according to the second embodiment without a shield.
Figure 12:
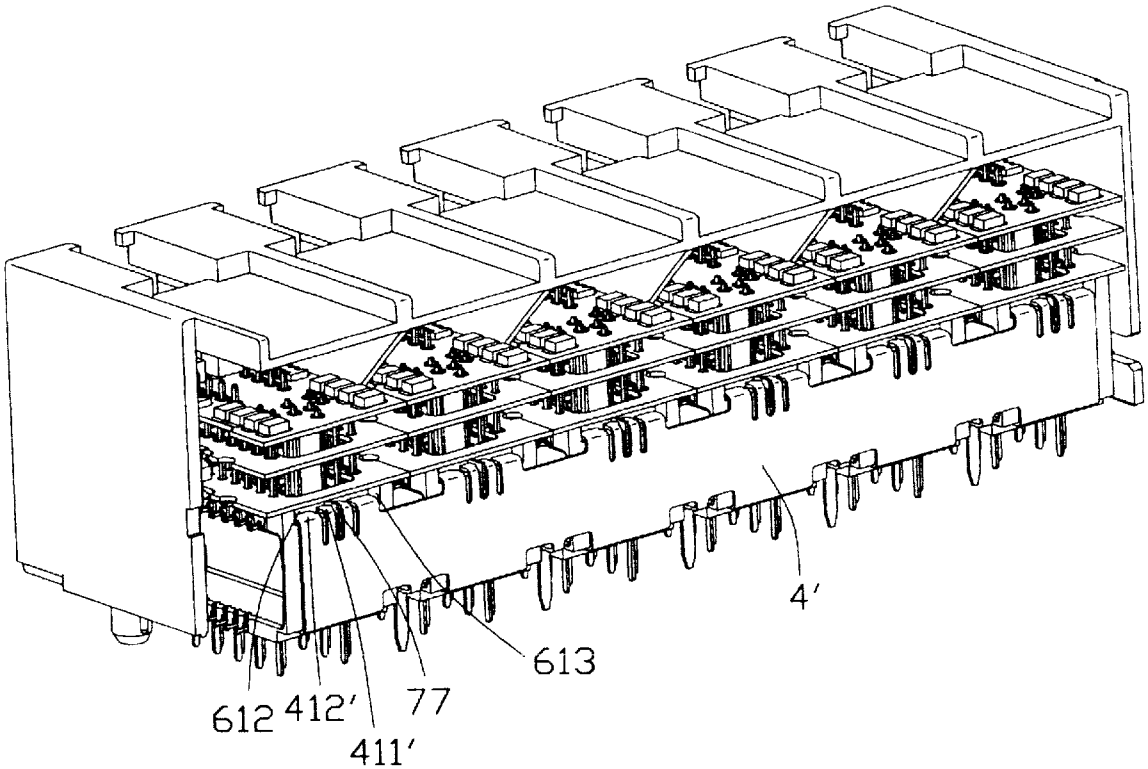
FIG. 12 shows an assembled view of FIG. 11.

FIGS. 10, 11 and 12 show a second embodiment of the present invention. Referring to FIG. 10, an inner ground plate 7' of a modular jack (not shown) according to the second embodiment is similar to the inner ground plate 7 of the modular jack 100 in the first embodiment, except that, the inner ground plate 7' has an additional grounding pin 711 extending upwardly and in parallel with the grounding pin 71', and a first and a second engaging extensions 76, 77 respectively extending latterly from opposite side edges of a body portion 70'.

Referring to FIG. 11, the first and the second engaging extensions 76, 77 of the inner ground plate 7' protrude laterally beyond the magnetic boxes 61', 62'. Each of the first and the second magnetic boxes 61', 62' has a retention recess 613, 623 in opposite upper sides thereof. The third internal PCB 53' has an additional grounding through hole 534 aligned with the grounding through hole 533'. The grounding pin 71' and the additional grounding pin 711 are respectively soldered in the grounding through hole and the additional grounding through hole 533', 534.

A rear ground plate 4' according to the second embodiment is different from the rear ground plate 4 of the first embodiment. The rear ground plate 4' has a planar body plate 40', a plurality of lower grounding contact 43' extending downwardly from the planar body plate 40' and a plurality of upper grounding contact sets 41' extending forwardly from upper portion of the planar body portion 40'. Each upper grounding contact set 41 ' has a pair of flexible beams 411' with inner ends abutting each other and a pair of retention tabs 412' respectively adjacent the flexible beams 411'.

Referring to FIGS. 11, 12, the rear ground plate 4' is attached to a rear portion of the magnetic assembly, the retention tabs 412' respectively engage with the retention recesses 613, 623. The engaging extension 77 of each internal ground plate 7' is received between the flexible tabs 411' of a corresponding upper grounding contact set 41' and thereby electrically connecting the internal ground plate 7' with the rear ground plate 4'. It is obvious that the rear ground plate 4' can be dimensioned to attached to a front portion of the magnetic assembly, with the flexible tabs 411' receiving the engaging portion 76 of the rear ground plate 4' therein, or two rear ground plates 4' can be respectively attached to front and rear portions of the magnetic assembly, thereby removing the noises more promptly.

It is to be understood, however, that even though numerous, characteristics and advantages of the present invention have been set fourth in the foregoing description, together with details of the structure and function of the invention, the disclosed is illustrative only, and changes may be made in detail, especially in matters of shape, size, and arrangement of parts within the principles of the invention to the full extent indicated by the broad general meaning of the terms in which the appended claims are expressed.

What is claimed is:

1. A multi-port modular jack comprising:

an insulative housing defining a plurality of upper and lower cavities for receiving a plurality of mating modular plugs and a rear opening;

a plurality of insert modules received in the rear opening, each of the plurality of insert modules including a plurality of lower and upper contacts, a first, second and third internal printed circuit boards, each of the upper contacts having an upper contact portion extending into a corresponding upper cavity for electrically engaging with a modular plug and an upper solder portion for surface mounting to the second internal printed circuit board, each of the lower contacts having a lower contact portion inserted into a corresponding lower cavity for electrically engaging with a corresponding modular plug and a lower solder portion for surface mounting to the first internal printed circuit board; and a rear ground plate coupled to a rear portion of the housing and front portions of the plurality of insert modules, the rear ground plate including a generally planar body plate, a plurality of upper grounding contacts projecting forwardly from an upper portion of the body plate and generally perpendicular to the body plate, a plurality of lower grounding contacts extending downwardly from a lower portion of the body plate and offset from the body plate, each of the plurality of upper grounding contacts being preferably forked with upper and lower tabs receiving a rear portion of and engaging with grounding pads of the corresponding third internal printed circuit board;

wherein each of the plurality of insert modules further has an internal ground plate connecting to the internal printed circuit boards, the internal ground plate having engaging extensions for electrically engaging with the rear ground plate.

2. The electrical connector according to claim 1 further includes a shell substantially surrounding the housing, the shell having solder tails extending downwardly, each said lower grounding contact close to the a corresponding solder tail.

* * * * *